US012005543B2

(12) United States Patent
Enegren

(10) Patent No.: US 12,005,543 B2
(45) Date of Patent: Jun. 11, 2024

(54) RADIUS ADJUSTMENT APPARATUS FOR USE WITH A GRINDING MACHINE

(71) Applicant: Paul Enegren, Wichita, KS (US)

(72) Inventor: Paul Enegren, Wichita, KS (US)

( * ) Notice: Subject to any disclaimer, the term of this patent is extended or adjusted under 35 U.S.C. 154(b) by 0 days.

(21) Appl. No.: 18/133,015

(22) Filed: Apr. 11, 2023

(65) Prior Publication Data

US 2023/0330801 A1 Oct. 19, 2023

Related U.S. Application Data

(60) Provisional application No. 63/330,353, filed on Apr. 13, 2022.

(51) Int. Cl.
*B24B 27/00* (2006.01)
*B24B 41/02* (2006.01)

(52) U.S. Cl.
CPC ..... *B24B 27/0084* (2013.01); *B24B 27/00* (2013.01); *B24B 41/02* (2013.01)

(58) Field of Classification Search
CPC ..... B24B 5/16; B24B 5/26; B24B 19/009; B24B 19/26; B24B 27/0084; B24B 41/06; B24B 41/02; B24B 27/00
USPC ..... 451/387, 393, 394, 396
See application file for complete search history.

(56) References Cited

U.S. PATENT DOCUMENTS 507,639 A * 10/1893 Smith ..... B24B 19/28 451/396
2,637,145 A * 5/1953 Wasley ..... B24B 19/28 451/396
2,755,602 A * 7/1956 Evans ..... B24B 13/04 451/271
2,771,723 A * 11/1956 Burleson ..... B24B 3/02 451/396
4,635,403 A * 1/1987 Makino ..... B24B 21/002 451/227
5,377,456 A * 1/1995 Dixon ..... B24B 9/144 451/384

(Continued)

FOREIGN PATENT DOCUMENTS

EP 0384093 A1 * 8/1990 ..... B24B 41/02

OTHER PUBLICATIONS

Beltra, EP-0384093-A1 machine translation, Aug. 29, 1990 (Year: 1990).*

*Primary Examiner* — Brian D Keller
*Assistant Examiner* — Marcel T Dion
(74) *Attorney, Agent, or Firm* — Dale J. Ream

(57) ABSTRACT

A radius adjustment apparatus includes a yoke assembly having a yoke body defining a threaded inner channel and a threaded yoke adjuster rod situated in the inner channel, the threads meshing together such that the yoke body is moved forwardly or rearwardly upon rotation of the adjuster rod. The adjuster rod is actuated by an attached adjuster knob. The yoke includes a pair of yoke arms each having a proximal end coupled to the yoke body and a distal end coupled to opposed ends of a bearing arm, the bearing arm extending between the distal ends. The bearing arm may be flexed or arched about a midpoint attachment fastener. A carriage, which may be coupled to a traditional grinding machine, is slidably coupled to the bearing rail for manual movement therealong. Slidable movement along the flexed or arched bearing rail causes a workpiece to receive a spherical or circular grind.

21 Claims, 5 Drawing Sheets

(56) References Cited

U.S. PATENT DOCUMENTS

2019/0366495 A1* 12/2019 Shindo ..... B23Q 1/017

* cited by examiner

RADIUS ADJUSTMENT APPARATUS FOR USE WITH A GRINDING MACHINE

REFERENCE TO RELATED APPLICATIONS

This application claims the benefit of provisional patent application 63/330,353 filed Apr. 13, 2022, titled Radius Adjustment Apparatus for Use with a Grinding Machine, the entirety of which is incorporated herein by reference.

BACKGROUND OF THE INVENTION

This invention relates generally to machines for grinding and, more particularly, to a radius adjustment apparatus for selectively adjusting an arc of a bearing rail upon which a carriage reciprocates as a grinding machine grinds a workpiece. Accordingly, the workpiece may be grinded in a spherical or selected radius in correlation to an arc imparted on the bearing rail.

A grinding machine, often referred to simply as a grinder, is one of power tools or machine tools used for grinding. It is a type of machining using an abrasive wheel as the cutting tool. Grinding machines remove material from the workpiece by abrasion. Typical grinding devices simply remove irregularities, cracks, debris, and other abrasions from a planar surface and then leave a new and cleaner rectangular surface.

Although presumably effective for their intended purposes, the existing grinding devices are not conducive for grinding a workpiece to have a round or spherical configuration. Specifically, existing designs and products are not appropriate alone for reconditioning certain automotive components.

Therefore, it would be desirable to have a radius adjustment apparatus that may be coupled to and used with a traditional grinding machine such that a workpiece may be modified to have a round or spherical configuration.

SUMMARY OF THE INVENTION

Therefore, a general object of this invention is to provide a radius adjustment apparatus configured for selectively modifying a radius of a workpiece being grinded, sanded, or the like such as for grinding spherical, circular, or curved workpieces.

Another object of this invention is to provide a radius adjustment apparatus, as aforesaid, that may be connected to traditional grinding machines.

Still another object of this invention is to provide a radius adjustment apparatus, as aforesaid, that includes a yoke assembly having a pair of yoke arms that are configured to bend or flex a bearing rail as they are moved longitudinally rearward by a yoke adjuster knob operated by a user.

Yet another object of this invention is to provide a radius adjustment apparatus, as aforesaid, in which a carriage coupled to a grinding machine is moved slidably along the flexed bearing rail to facilitate a curved or spherical grinding of a workpiece held by the grinding machine.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
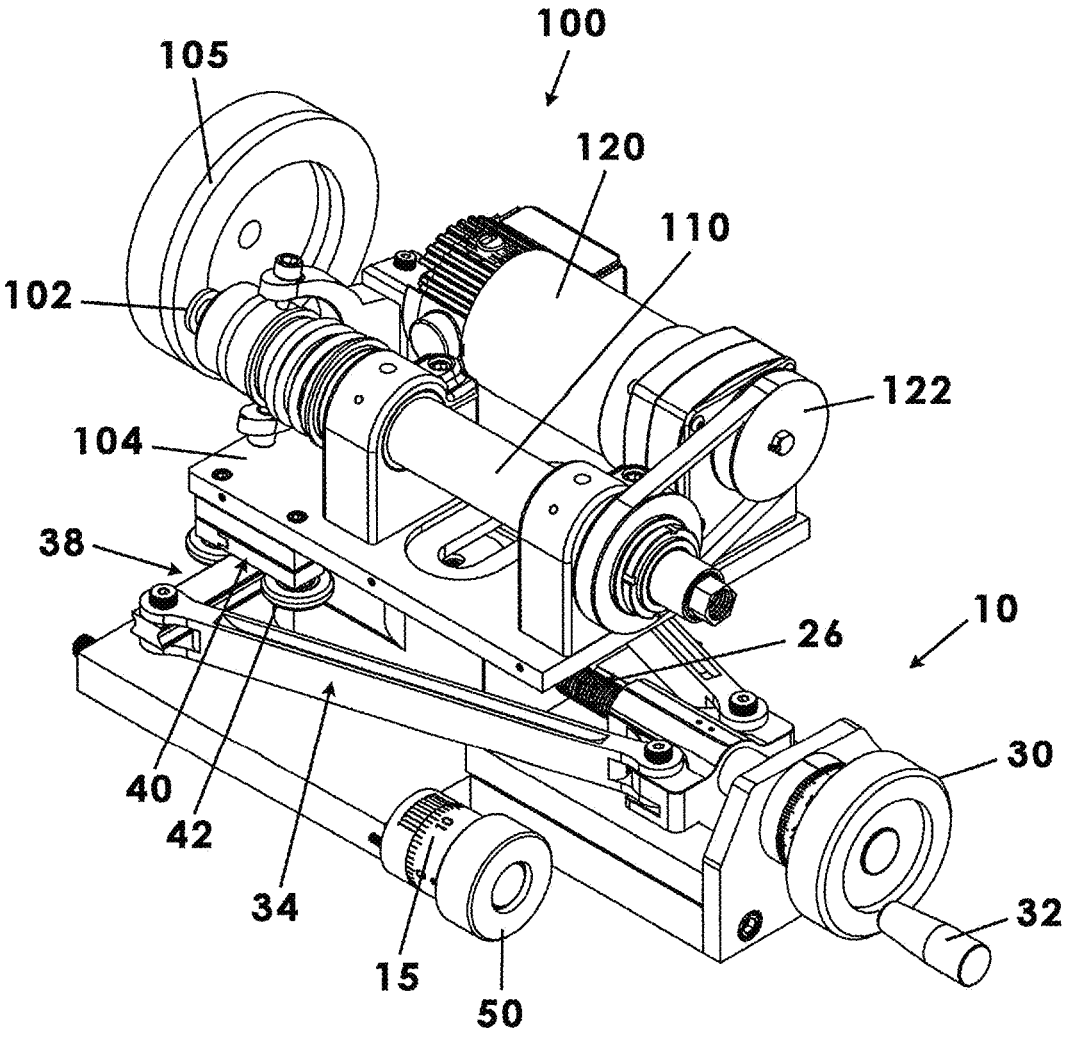
FIG. 1 is a perspective view of a radius adjustment apparatus according to a preferred embodiment of the present invention, illustrated in use on a grinding machine.
Figure 2:
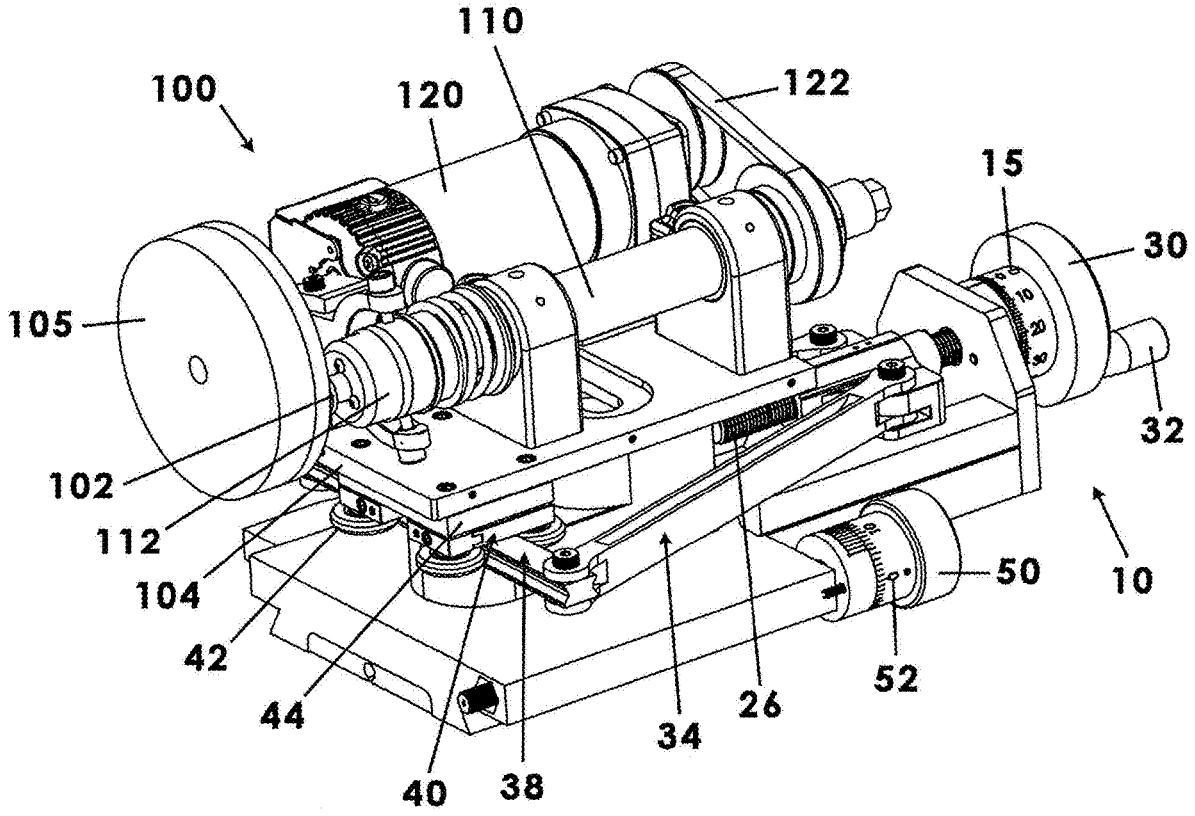
FIG. 2 is another perspective you taken from a lower and rearward angle of the radius adjustment apparatus and grinding machine illustrated in FIG. 1.
Figure 3:
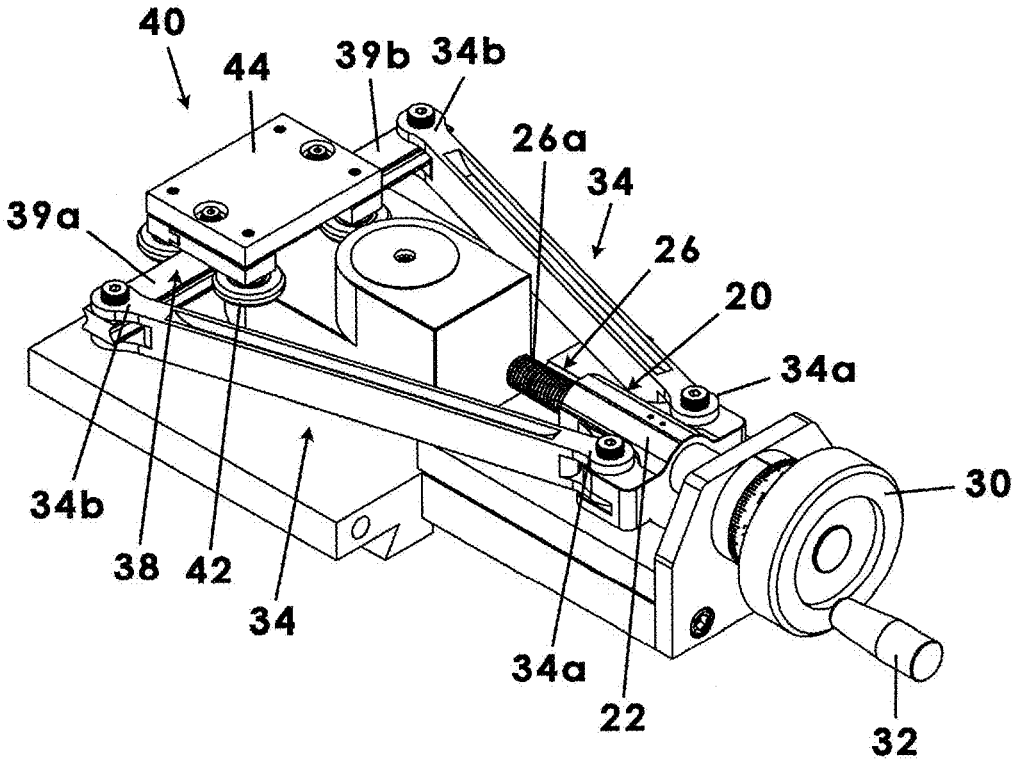
FIG. 3 is a perspective view of the radius adjustment apparatus according to the present invention removed from the grinding machine.
Figure 4A:
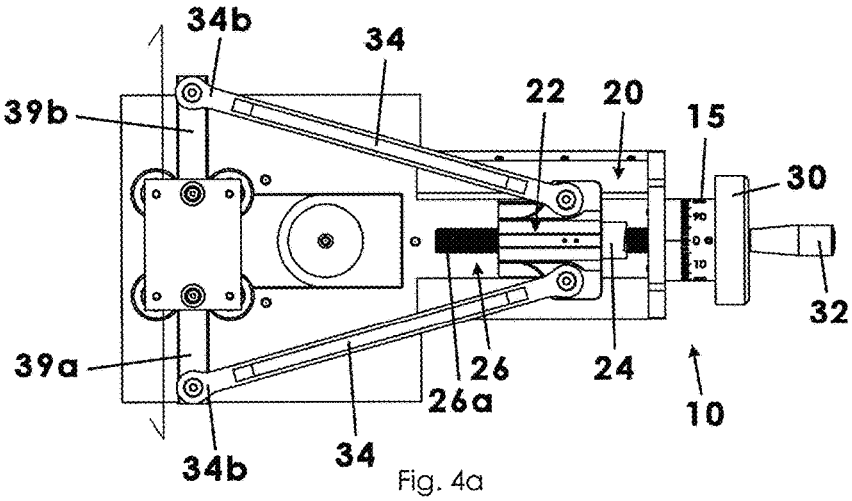
FIG. 4*a* is a top view of the radius adjustment apparatus according to the present invention.
Figure 4B:
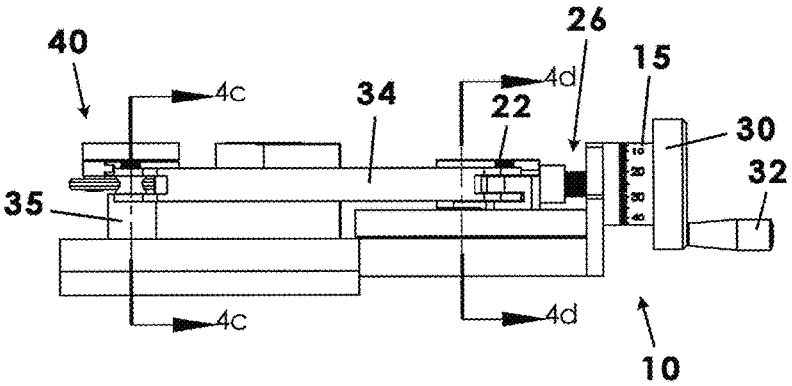
FIG. 4*b* is a side view of the radius adjustment apparatus as in FIG. 4*a;*
Figure 4C:
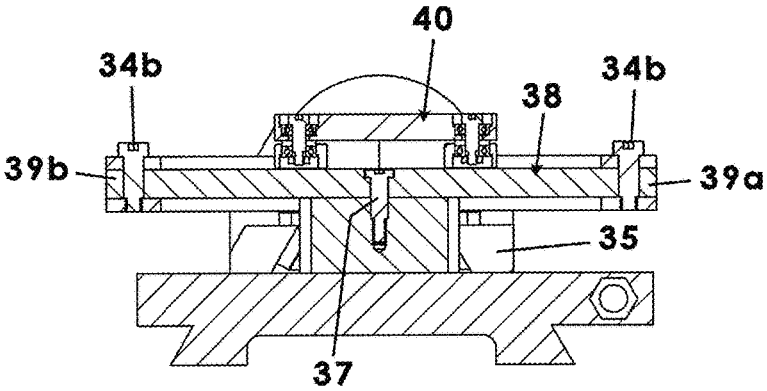
FIG. 4*c* is a sectional view taken along line 4*c*-4*c* of FIG. 4*b;*
Figure 4D:
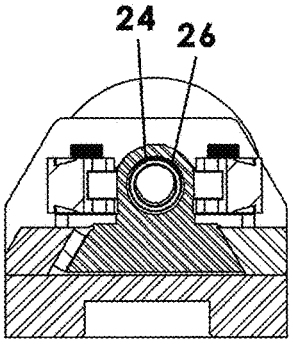
FIG. 4*d* is a sectional view taken along line 4*d*-4*d* of FIG. 4*b*.

A radius adjustment apparatus according to a preferred embodiment of the present invention will now be described with reference to FIGS. 1 to 5 of the accompanying drawings. The radius adjustment apparatus 10 includes a yoke assembly 20 having a yoke body 22, a yoke adjuster rod 26, a yoke adjuster knob 30, a pair of yoke arms 34, a bearing rail 38, and a carriage 40.

The radius adjustment apparatus 10 configured to cause a workpiece to be grinded in a spherical or curved manner may be operatively coupled to a traditional grinding machine. Accordingly, it is important to describe and comprehend a traditional grinding or sanding machine. As shown particularly in FIGS. 1 and 2 of the present illustrations, a conventional grinding machine 100 may include a longitudinally elongate spindle 110 that is configured to firmly hold the workpiece 102 whose shape is to be modified by contact with a grinding wheel 105 (or with a power sanding wheel or the like). It is understood that a workpiece 102 may also be referred to as a tappet in that the rotary motion of the spindle 110 is converted to linear motion—in this instance by moving the grinding wheel 105 linearly into or out of contact with the workpiece 102 which is spun radially by actuation of the spindle 110. Further, the holding portion of the spindle 110 may include a collet holder 112 or similar fastener that may be selectively tightened to hold the workpiece securely. In use, the workpiece 102 may be an automotive engine component that is being reconditioned such, for instance, a valve lifter.

Further, the traditional grinding machine 100 may include a spindle motor 120 coupled to the spindle 110 such as by a series of wheels and belts 122 such that the spindle 110 may be rotated at a selected revolutions per minute (RPM) when the spindle motor 120 is electrically energized. Finally, the traditional grinding machine 100 and its spindle motor 120, spindle 110, and related components are mounted atop a grinder framework 104 such as a plate to which the radius adjustment apparatus 10 may be operatively coupled as will be described below.

The radius adjustment apparatus 10 according to the present invention may now be described in detail. Namely, the radius adjustment apparatus 10 may include a yoke assembly that is configured to adjust the radius of the workpiece 102 being held and grinded by the grinding machine 100 described above. More particularly, the yoke assembly 20 may include a yoke body 22 defining an inner channel having a plurality of internal threads and a yoke adjuster rod 26 having a plurality of external threads 26*a*. Further, the yoke assembly 20 may include a pair of yoke arms 34 each having a linear configuration and being identical to the other. The yoke body 22 defines an inner channel 24 that extends longitudinally through the entire yoke body 22, i.e., the yoke body 22 has longitudinally opposed inlet and outlet openings providing access to the inner channel 24.

Further, the yoke assembly 20 includes a yoke adjuster rod 26 positioned in and extending along the inner channel 24 and configured for incremental movement therein. More particularly, the inner channel may include a plurality of inner threads whereas an outer surface of the yoke adjuster rod 26 includes a plurality of external threads 26*a*. It is understood that the yoke adjuster rod 26 has a dimension that is complementary to that of the inner channel (e.g., slightly smaller diameter) such that the internal and external threads 26, respectively, engage or mesh together to enable the yoke body 22 to move longitudinally when the yoke adjuster rod 26 is actuated, e.g., is rotated. Even more particularly, the yoke body 22 may be translated forwardly when the yoke adjuster rod 26 is rotated in a first direction (e.g., clockwise) whereas the yoke body 22 may be translated rearwardly when the yoke adjuster rod 26 is rotated in a second direction (e.g., counter-clockwise).

In a related aspect, each yoke arm 34 includes a proximal end 34*a* coupled to the yoke body 22, the proximal ends 34*a* being laterally displaced from one another such that the inner channel and yoke adjuster rod 26 is situated intermediate the proximal ends 34*a*. It is understood that this geographic relationship maintains smooth longitudinal movement of the yoke body 22 when the yoke adjuster rod 26 is rotated.

The yoke adjuster rod 26 is moved by manual and radial operation of a yoke adjuster knob 30. In a critical aspect, the yoke assembly 20 may include a yoke adjuster knob 30 coupled to an outer end of said yoke adjuster rod 26 and may include a handle 32 that enables a user to selectively actuate the yoke adjuster rod 26 to rotate with careful precision. Accordingly, the yoke body 22 may be slidably translated forwardly or rearwardly by radial operation of the yoke adjuster knob 30 in clockwise or counter-clockwise directions, respectively. The adjuster knob 30 may include indica 15 to enable a user to rotate the knob according to numerical quantities corresponding to respective movements the yoke adjuster rod 26 and yoke arms 34. More particularly, the indicia 15 make it possible for a user to make rotations of the adjuster knob 30 that are selectively adjustable, are predictable, and may be accurately repeated on multiple workpieces if desired.

Figure 5:
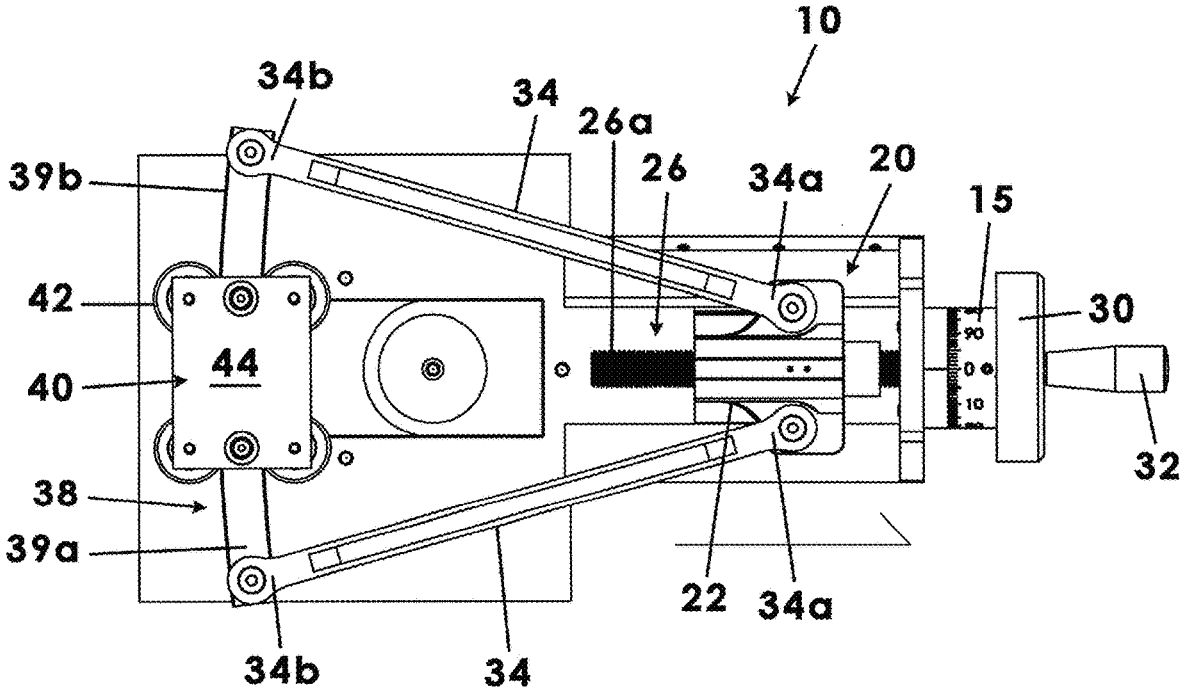
FIG. 5 is a top view of the radius adjustment apparatus as in FIG. 4*a* illustrated showing the pair of yoke arms and the yoke body member moved in a rearward direction such that the bearing rail is in a flexed configuration according to the present invention.

Now with further regard to the pair of yoke arms 34, each yoke arm 34 includes a proximal end 34*a* coupled to the yoke body 22 and each yoke arm 34 includes a distal end 34*b* opposite a proximal end 34*a*. Each distal end 34*b* may be coupled to first and second ends 39*a*, 39*b* of a bearing rail 38, respectively, the bearing rail 38 having a normally linear configuration extending between distal ends 34*b* of the pair of yoke arms 34. The bearing rail 38 includes a first end 39*a* and a second end 39*b* opposite the first end 39*a*, the bearing rail ends being coupled to the distal ends 34*b*, respectively (FIG. 5).

In another critical aspect, a midpoint of the bearing rail 38 may be fixedly attached to a base frame member 35 (FIG. 4*c*) with a fastener such as with a bolt 37, pin, or the like. Also critical, the bearing rail 38 is constructed of a semi-rigid material that is capable of bending or flexing when its ends are subjected to a load. In other words, when the yoke body is threadably moved rearwardly, such as by clockwise movement of the yoke adjuster knob 30, the pair of yoke arms 34 are likewise pulled rearwardly, causing the bearing rail 38 to arc/flex/bend as shown in FIG. 5. More particularly, the bearing rail 38 flexes or becomes arch-like about an imaginary vertical axis defined by the bolt 37. In summary, the bearing rail 38 is therefore movable between a normally linear (straight) configuration when no load is placed on the bearing rail 38 (i.e., the yoke body 22 is moved sufficiently forwardly as described above) and a flexed or arced configuration according to a load placed upon the ends of the bearing rail 38 (i.e., the yoke body 22 is moved sufficiently rearwardly by a respective rotation of the yoke adjuster rod 26).

In another aspect, a carriage 40 is slidably coupled to said bearing rail 38 using a plurality of bearings 42 and is slidable laterally between said second ends 39*a*, 39*b* of the pair of yoke arms 34. In an embodiment, the carriage is moved reciprocally along the bearing rail 38 manually by a user although programmed movement powered by electricity or a motor is contemplated in some embodiments. Further, the carriage 40 may have an upper surface referred to as a carriage plate 44 selectively coupled to the framework 104 of a grinding machine 100. Accordingly, a lateral movement of the carriage 40 along the bearing rail 38 causes a corresponding movement of the grinding machine 100 and, as a result, a lateral movement of the workpiece 102.

In addition, the radius adjustment assembly 10 may include an auxiliary adjustment wheel 50 configured for moving the entire yoke assembly 20 longitudinally, such as closer or further away from the grinding wheel shown in FIG. 1. Further, each adjustment wheel may include graduated measurement lines and associated indicia 15 to aid a user in determining a desired adjustment amount.

In use, the radius adjustment apparatus 10 may be coupled to the traditional grinding machine 100 of a type having a grinding wheel 105 and a spindle 110 configured to hold a workpiece 102 in close proximity to the grinding wheel 105, the workpiece being, for instance, a valve lifter or the like. With the grinding wheel 105 is actuated and spinning, the user is free to operate the yoke adjuster knob 30 which axially rotates the yoke adjuster rod 26 which threadably moves the yoke body 22 rearwardly which, in turn, pulls the pair of yoke arms 34 which, in turn, puts a load on respective ends of the bearing rail 38 which, in turn causes the bearing rail 38 to bend or become arched as shown in FIG. 5. Finally, the auxiliary adjustment wheel 50 may be operated to move the entire apparatus forwardly such that the workpiece 102 is in communication with the grinding wheel 105 and the carriage 40 may be manually articulated along the now arched bearing rail 38 such that a curved or spherical radius is imparted to the workpiece 102.

It is understood that while certain forms of this invention have been illustrated and described, it is not limited thereto except insofar as such limitations are included in the following claims and allowable functional equivalents thereof.

The invention claimed is:

1. A radius adjustment apparatus for combination with a grinding machine of a type having a spindle configured to hold a workpiece adjacent a grinding wheel, said radius adjustment apparatus, comprising:

a yoke assembly including a yoke body defining an inner channel and a yoke adjuster rod operatively positioned in said inner channel for selectively moving said yoke body linearly along said yoke adjuster rod when said yoke adjuster rod is actuated;

a yoke adjuster knob coupled to an outer end of said yoke adjuster rod, said yoke adjuster rod being actuated to rotate according to rotational movement of said yoke adjuster knob in a forward direction or a rearward direction, respectively;

a pair of yoke arms each having a proximal end coupled to said yoke body and a distal end opposite said proximal end;

a bearing rail having opposed first and second ends coupled to said distal ends of said pair of yoke arms, respectively, said bearing rail extending perpendicular to the yoke adjuster rod between said distal ends of said pair of yoke arms, respectively;

wherein said bearing rail has a mid-point between said opposed first and second ends that is coupled to a base frame member with a pin;

wherein said bearing rail is constructed of a semi-flexible material that is configured to flex about said pin when said yoke adjuster rod is actuated;

a carriage slidably coupled to said bearing rail and is slidable laterally between said second ends of said pair of yoke arms when actuated;

wherein:

said bearing rail is movable between a linear configuration when said yoke adjuster body is moved forwardly and a flexed or arced configuration when said yoke adjuster body is moved rearwardly;

said carriage is configured to move slidably along said flexed or arced configuration.

2. The radius adjustment apparatus as in claim 1, wherein said inner channel includes a plurality of internal threads and said yoke adjuster rod includes a plurality of external threads positioned to interact with said plurality of internal threads for selectively moving said yoke body forwardly or rearwardly along said yoke adjuster rod when said yoke adjuster rod is actuated.

3. The radius adjustment apparatus as in claim 2, wherein said yoke adjuster knob has a circular configuration such that rotational movement of said yoke adjuster knob causes linear movement of said yoke body.

4. The radius adjustment apparatus as in claim 1, wherein, said yoke adjuster rod is situated intermediate said proximal ends of said pair of yoke arms.

5. The radius adjustment apparatus as in claim 4, wherein said pair of yoke arms are arranged in a generally V-shaped configuration such that said proximal ends are proximate one another and said distal ends are outwardly displaced from one another.

6. The radius adjustment apparatus as in claim 5, wherein said pair of yoke arms are pulled rearwardly when said yoke body is moved rearwardly by actuation of said yoke adjuster rod.

7. The radius adjustment apparatus as in claim 1, wherein said carriage is slidably coupled to said bearing rail using a plurality of bearings.

8. The radius adjustment apparatus as in claim 1, wherein said carriage includes a carriage plate that is coupled to the spindle of the grinding machine, whereby the grinding machine is moved in cooperation with movement of said carriage.

9. The radius adjustment apparatus as in claim 1, wherein said yoke adjuster knob includes a plurality of numerical indicia so that movement of the yoke adjuster knob is adjustable and repeatable.

10. A radius adjustment apparatus for combination with a grinding machine of a type having a spindle rotationally operated by electrical connection to a spindle motor and configured to hold a workpiece adjacent a grinding wheel said radius adjustment apparatus, comprising:

a yoke assembly including a yoke body defining an inner channel and a yoke adjuster rod operatively positioned in said inner channel for threadably moving said yoke body linearly along said yoke adjuster rod when said yoke adjuster rod is actuated;

a yoke adjuster knob coupled to an outer end of said yoke adjuster rod, said yoke adjuster rod being actuated to rotate when said yoke adjuster knob is actuated in a forward direction or a rearward direction, respectively;

a pair of yoke arms each having a proximal end coupled to said yoke body and a distal end opposite said proximal end;

a bearing rail having opposed first and second ends coupled to said distal ends of said pair of yoke arms, respectively, said bearing rail extending perpendicular to the yoke adjuster rod between said distal ends of said pair of yoke arms, respectively;

wherein said bearing rail has a mid-point between said opposed first and second ends that is coupled to a base frame member with a fastener;

wherein said bearing rail is constructed of a semi-flexible material that is configured to flex about an imaginary vertical axis defined by said fastener when said yoke adjuster rod is actuated;

wherein said bearing rail is movable between a linear configuration when no load is placed on the bearing rail and a flexed or arced configuration when said yoke adjuster body is moved rearwardly; and a carriage slidably coupled to said bearing rail and slidable thereon between said second ends of said pair of yoke arms when actuated, said carriage including a carriage plate that is coupled to the spindle of the grinding machine such that the grinding machine is moved in cooperation with movement of said carriage when said bearing rail is at said flexed or arced configuration.

11. The radius adjustment apparatus as in claim 10, wherein said fastener is one of a pin and a bolt.

12. The radius adjustment apparatus as in claim 10, wherein said inner channel includes a plurality of internal threads and said yoke adjuster rod includes a plurality of external threads positioned to interact with said plurality of internal threads for selectively moving said yoke body forwardly or rearwardly along said yoke adjuster rod when said yoke adjuster rod is actuated.

13. The radius adjustment apparatus as in claim 10, wherein said yoke adjuster knob has a circular configuration such that rotational movement of said yoke adjuster knob causes linear movement of said yoke body.

14. The radius adjustment apparatus as in claim 13, wherein said yoke adjuster knob includes a plurality of numerical indicia arranged so that movement of the yoke adjuster knob by a user is adjustable, predictable, and repeatable.

15. The radius adjustment apparatus as in claim 10, wherein, said yoke adjuster rod is situated intermediate said proximal ends of said pair of yoke arms.

16. The radius adjustment apparatus as in claim 10, wherein said pair of yoke arms are arranged in a generally V-shaped configuration in which said proximal ends are proximate one another and said distal ends are outwardly displaced from one another.

17. The radius adjustment apparatus as in claim 16, wherein pair of yoke arms are pulled rearwardly when said yoke body is moved rearwardly by actuation of said yoke adjuster rod.

18. A method for adjusting a radius of a workpiece held adjacent a grinding wheel of a grinding machine of a type having a spindle configured to hold a workpiece, said method comprising:

providing a bearing rail having opposed first and second ends coupled to distal ends of a pair of yoke arms, respectively, said bearing rail being constructed of a semi-flexible material extending between said distal ends of said pair of yoke arms, respectively;

coupling said distal ends of each yoke arm to said opposed first and second ends of said bearing rail, said pair of yoke arms each including a linear configuration having a proximal end, respectively, said bearing rail having a mid-point between said opposed first and second ends that is coupled to a base frame member with a pin;

coupling a yoke assembly to the proximal ends of said pair of yoke arms, said yoke assembly including a yoke body defining an inner channel and a yoke adjuster rod operatively positioned in said inner channel for selectively moving said yoke body linearly along said yoke adjuster rod when said yoke adjuster rod is actuated wherein the yoke adjuster rod extends perpendicular to the bearing rail;

bending said bearing rail about said pin when said yoke body is moved away from said bearing rail when said yoke adjuster rod is actuated such that said bearing rail is moved to a flexed configuration; and slidably coupling a carriage to said bearing rail such that said carriage is slidable laterally between said second ends of said pair of yoke arms when said bearing rail is in the flexed configuration.

19. The method as in claim 18, further comprising providing a yoke adjuster knob operatively coupled to an outer end of said yoke adjuster rod such that said yoke adjuster rod is actuated to rotate according to rotational movement of said yoke adjuster knob in a forward direction or a rearward direction, respectively.

20. The method as in claim 19, wherein said pair of yoke arms are pulled away from said bearing rail when said yoke body is moved rearwardly by actuation of said yoke adjuster rod.

21. The method as in claim 18, wherein said carriage includes a carriage plate that is coupled to the spindle of the grinding machine, whereby the grinding machine is moved in cooperation with movement of said carriage.

* * * * *